US005595220A

United States Patent [19]

Leban et al.

[11] Patent Number: 5,595,220

[45] Date of Patent: Jan. 21, 1997

[54] PORTABLE CABLE TIE INSTALLATION TOOL

[75] Inventors: Joseph F. Leban, Warrenville; Robert F. Levin, Braceville; Mark B. Richardson, Joliet, all of Ill.

[73] Assignee: Panduit Corp., Tinley Park, Ill.

[21] Appl. No.: 374,463

[22] Filed: Jan. 18, 1995

[51] Int. Cl.[6] ..... B21F 09/02

[52] U.S. Cl. ..... 140/123.6; 140/93.2

[58] Field of Search ..... 140/93 A, 93.2, 140/123.6

[56] References Cited

U.S. PATENT DOCUMENTS 3,946,769 3/1976 Caveney et al. .
4,119,124 10/1978 Collier et al. .
4,178,973 12/1979 Collier et al. .
4,357,969 11/1982 Peterpaul .
4,357,970 11/1982 Netta et al. .
4,498,506 2/1985 Moody et al. .
4,640,319 2/1987 Walker .
5,167,265 12/1992 Sakamoto .
5,205,328 4/1993 Johnson et al. .

*Primary Examiner*—Lowell A. Larson
*Attorney, Agent, or Firm*—Mark D. Hilliard; Robert A. McCann

[57] ABSTRACT

A portable automatic cable tie installation tool for applying individual cable ties around bundles of wires or the like utilizing a rotary driven rod having a helical groove longitudinally formed along the rod as the cable tie advancing mechanism.

19 Claims, 19 Drawing Sheets

PORTABLE CABLE TIE INSTALLATION TOOL

TECHNICAL FIELD

The present invention relates generally to tools for the automatic application of individual cable ties to bundles of wires or the like, and specifically to a portable automatic cable tie application tool that utilizes a rotary driven rod having a helical groove longitudinally formed along the rod as a cable tie advancing mechanism.

BACKGROUND OF THE INVENTION

Many different tools for applying individual cable ties separated from a ribbon of interconnected cable ties, around a bundle of wires are known in the art. Portable hand tools of this type are possible when the mechanism for separating each cable tie from the cable tie ribbon is within the tool itself. Thus, individual cable tie ribbons of a manageable length are positioned in the portable tool which sequentially separates, advances and applies each cable tie. Prior automatic cable tie installation tools have utilized various reciprocating mechanisms such as a pushing rod or carriage as the cable tie advancing mechanism to transport the tie into application position around the bundle. Tools of this type still have drawbacks due to the requirement that the reciprocating member needs to be retracted in order to be in position to transport the next cable tie. Therefore, the simplification of the cable tie advancing mechanism will greatly reduce the complexity of the overall tool. Additionally, the elimination of a reciprocating transport mechanism allows for a shorter length tool and one which uses fewer moving parts.

Prior tools using reciprocating members or other more complex advancing systems also require complicated and precise timing mechanisms working in conjunction with the internal gearing and, therefore, can only be used on a single length cable tie.

Another problem of prior art tools is that when a bundle of wires is either too large or not properly situated within the front jaws of the application tool the cable tie can still be advanced within the tool resulting in a misfeed that can be problematic and time consuming to correct.

SUMMARY OF THE INVENTION

It is therefore an object of the present invention to provide a cable tie application tool having an improved cable tie advancing mechanism.

It is further an object of the present invention to provide a cable tie installation tool having a cable tie misfeed preventing mechanism.

It is still further an object of the present invention to provide a cable tie installation tool that can easily be used for application of different length ties.

These and other objects, together with the advantages thereof over existing prior art forms which will become apparent from the following detailed description, are accomplished by means hereinafter described.

In general, a cable tie application tool of the present invention includes cable tie positioning means for supporting and enclosing the cable tie around a bundle, cable tie receiver means for receiving and positioning the cable tie for advancement to the cable tie positioning means, tensioning and severing means for tensioning the cable tie around a bundle and removing the excess strap; and cable tie advancing means for transporting the cable tie from the receiving means to the positioning means, wherein the advancing means includes a rotary driven rod having a helical groove that engages with a head of the cable tie.

DETAILED DESCRIPTION OF THE INVENTION

A portable automatic cable tie installation tool embodying the concept of the present invention is generally indicated by the numeral 40 in the accompanying drawings.

Figure 4:
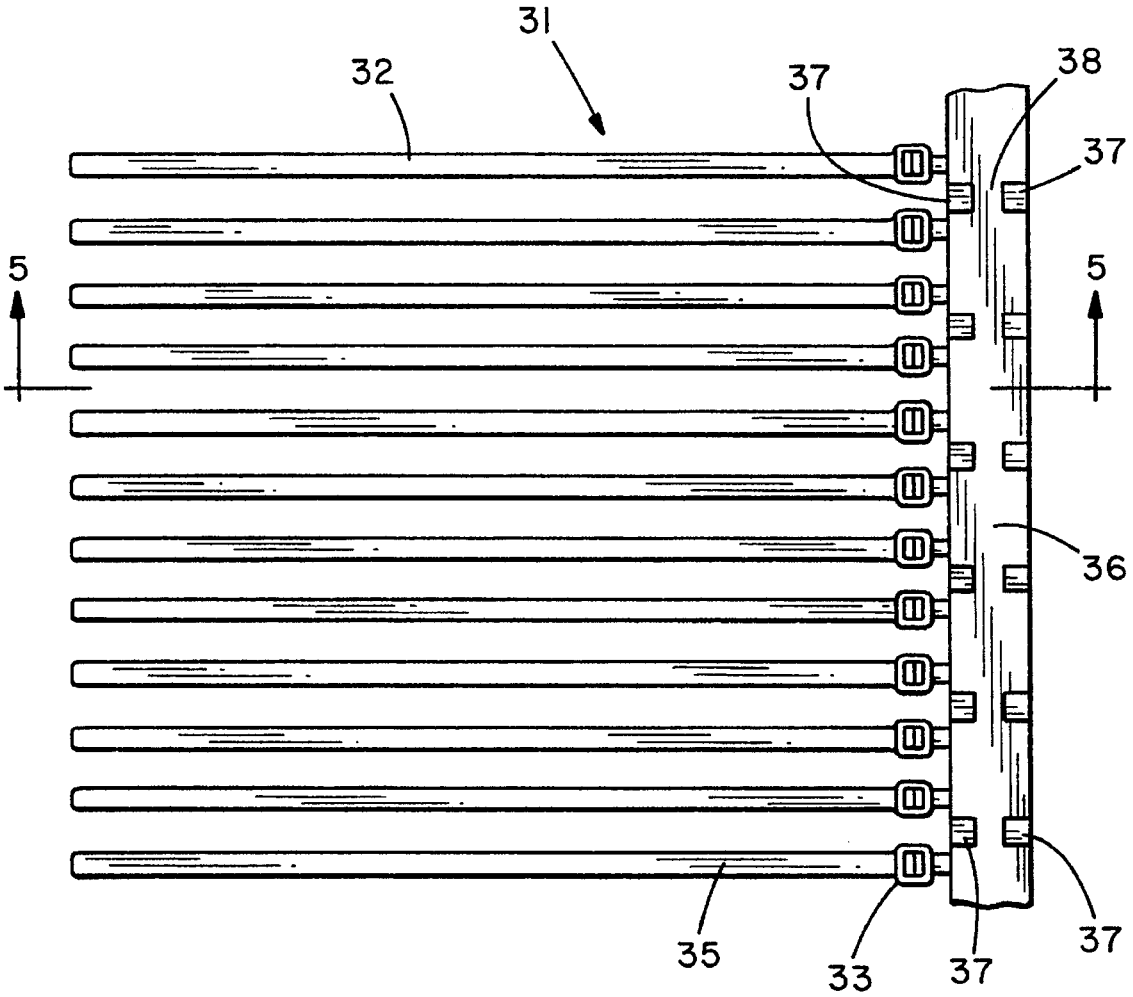
FIG. 4 is a top view of a ribbon of cable ties which is applied by the tool of FIG. 1.
Figure 5:
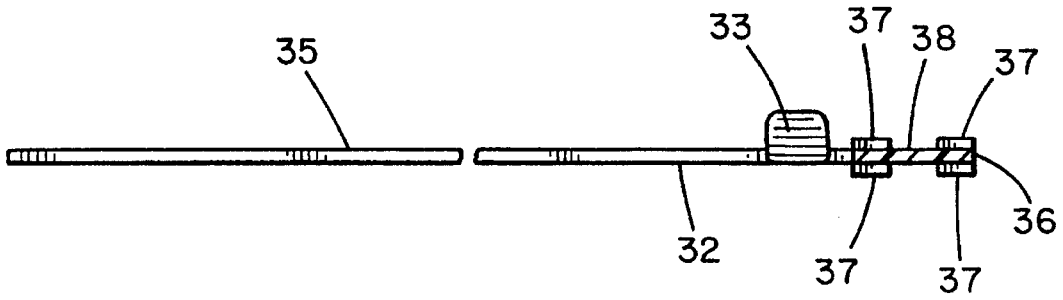
FIG. 5 is a sectional view taken along line 5-5 of FIG. 4.

Tool 40 is of the general type similar to prior tools made by applicants' common assignee, Panduit Corp., such as that described in U.S. Pat. No. 5,205,328, which is incorporated herein by reference and is designed to apply cable ties which are provided in ribbon form by applicants' common assignee, Panduit Corp., which are sold under the name "Continuously Molded, Reel-fed Cable Ties, PLT1M or PLT1.5M-XMR" and which are described in U.S. Pat. No. 4,498,506 which is incorporated herein by reference. As seen in FIGS. 4 and 5, an integrally formed ribbon of cable ties 31 includes a plurality of parallel cable ties 32 individually joined at their heads 33 to a strip portion 36 with the strap 35 of each cable tie 32 extending perpendicularly to the length of strip portion 36. Strip portion 36, which extends along the length of the ribbon 31, includes alignment guides 37 formed on opposite planar surfaces of strip portion 36 that define an alignment channel 38 for accurately laterally positioning ribbon 31. Tool 40 applies cable ties 32 around wires to form a wire bundle 30 as seen in FIG. 1.

Figure 1:
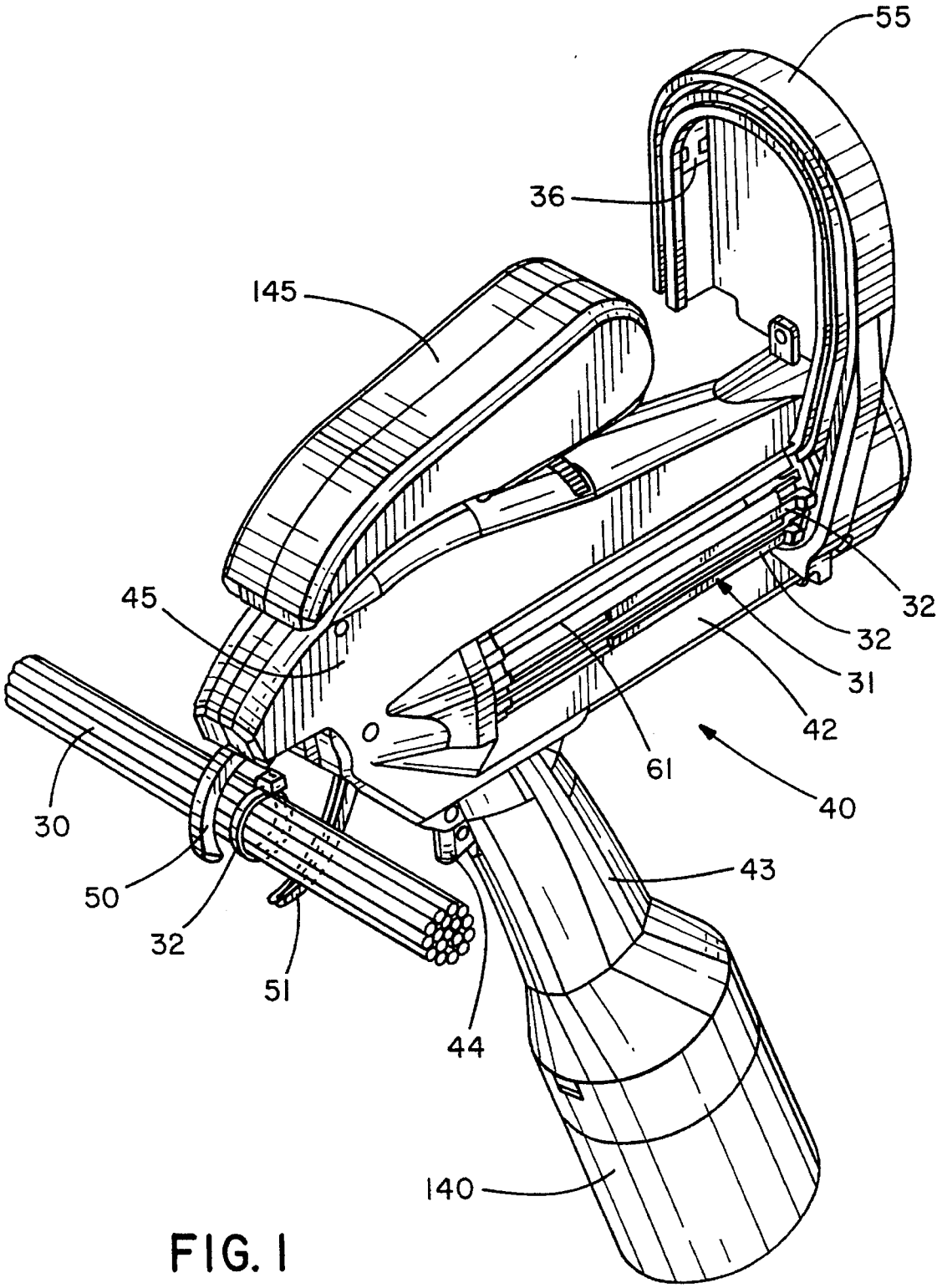
FIG. 1 is a perspective view of a portable automatic cable tie application tool embodying the concept of the present invention.
Figure 2:
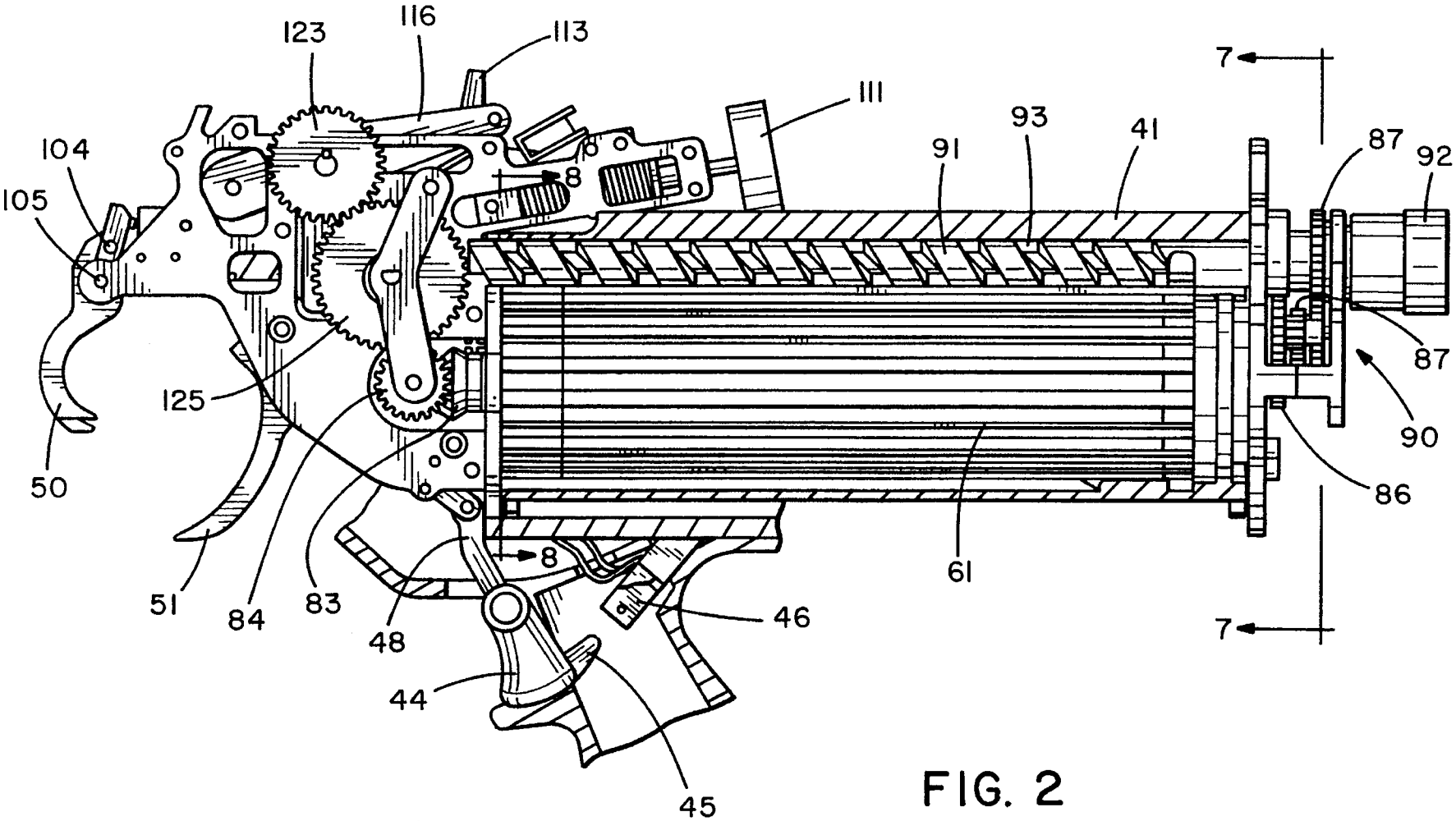
FIG. 2 is a first side view of the tool body of FIG. 1 shown with the housing removed.
Figure 3:
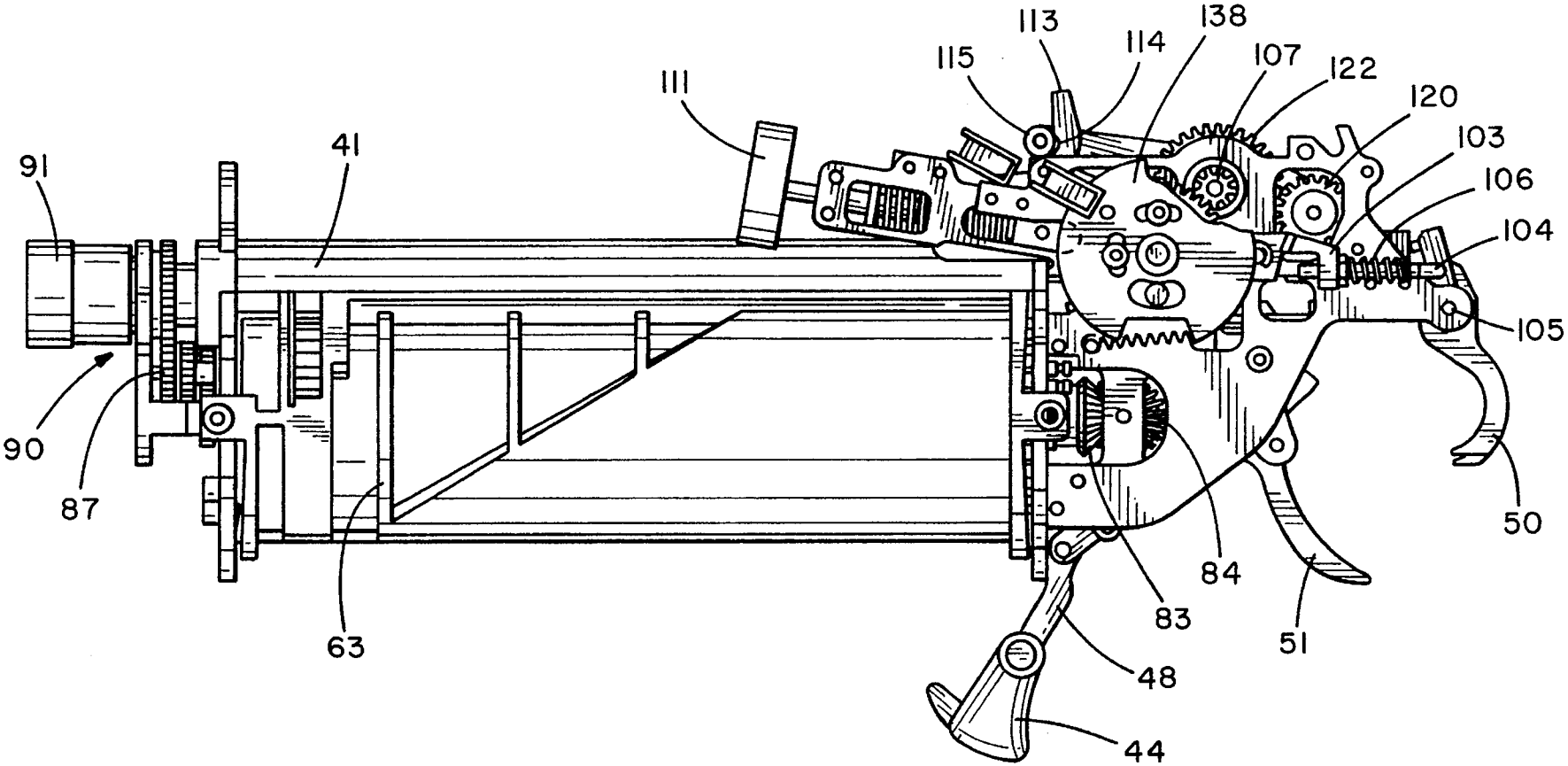
FIG. 3 is a second side view of the tool of FIG. 1 shown with the housing removed.

As seen in FIG. 1, tool 40 generally includes a tool housing 41 that substantially encloses the tool handle 43 and tool body 42 which include the working mechanisms of tool 40. A removable battery pack 140 is attached to tool 40 at the base of tool handle 43. An excess strap collector 145 that collects severed strap ends ejected from tool 40 through an ejection tie aperture (not shown) is attached to the top of tool body 42. Tool 40 is also provided with an upper jaw 50 and a lower jaw 51 for positioning cable tie 32 around a wire bundle 30 and a trigger 44 and switch mechanism 46 (not shown) that actuates the closing of the jaws 50, 51 around wire bundle 30 and also activates the tool control circuitry for the application of a cable tie 32 by tool 40.

Tool 40 includes the following mechanisms: a cable tie receiver mechanism 60 (FIGS. 6 and 8) that receives a cable tie ribbon, positions the ribbon, severs the leading cable tie from the ribbon, and positions the leading cable tie for subsequent advancement; a cable tie advancing mechanism 90 (FIGS. 11 and 12) which advances the leading cable tie from the cable tie receiver mechanism 60; a cable tie positioning mechanism 130 (FIGS. 12 and 16) which receives the cable tie from the cable tie advancing mechanism 90, positions the cable tie around a bundle of wires, for insertion of the strap end through the locking head of the cable tie; and a cable tie tensioning and severing mechanism 100 (FIGS. 13, 17 and 18) which threads the cable tie strap through the opening in the locking head, tightens the cable tie around the bundle to a desired tension, and severs the excess strap of the cable tie.

Figure 12:
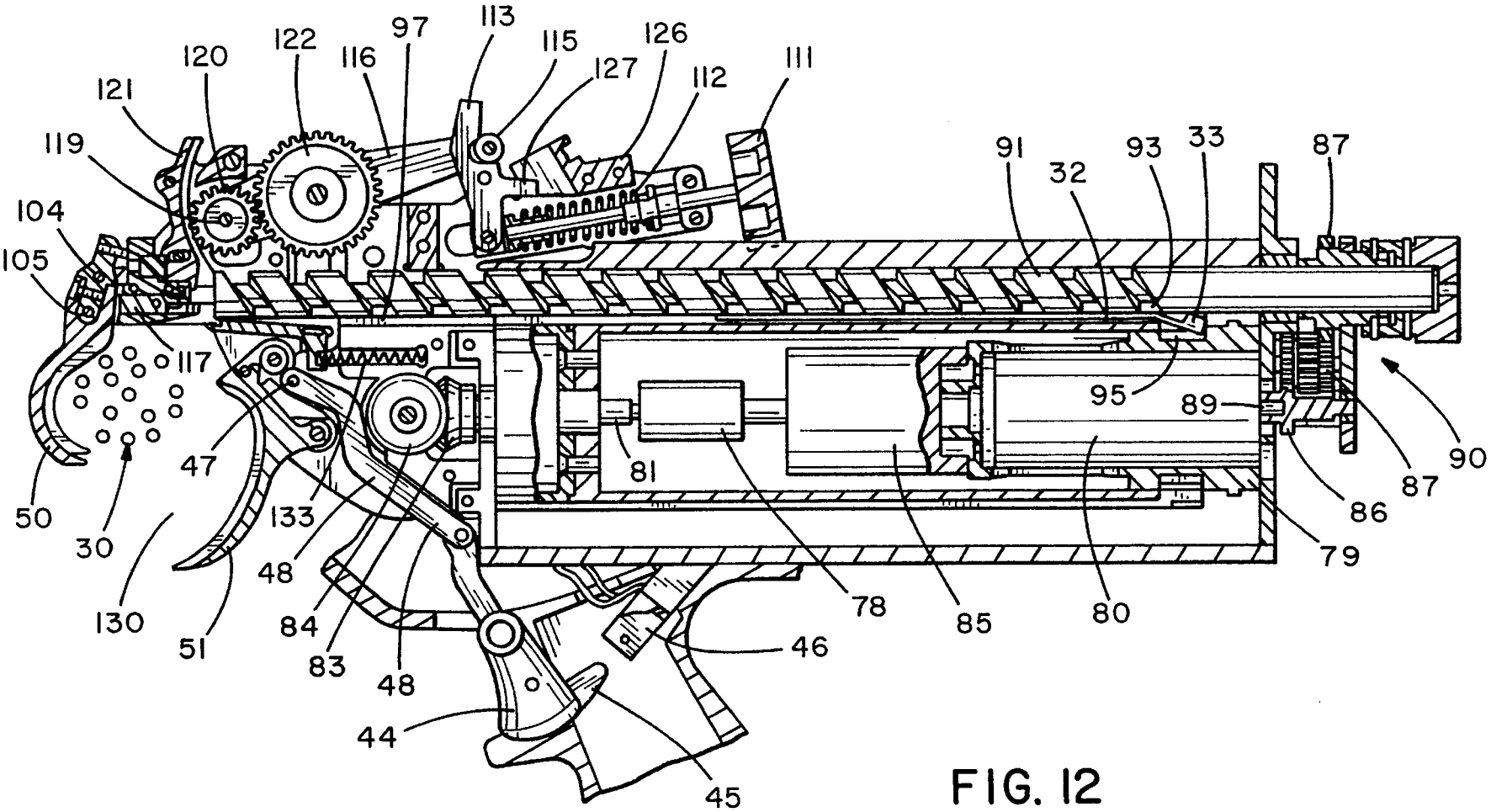
FIG. 12 is a side view partially in section of the tool body of the tool of FIG. 1, shown with a cable tie about to be loaded in the cable tie advancing mechanism.

The mechanisms of tool 40 are powered by a single motor 80 mounted in tool 40. As seen in FIG. 12, motor 80, through a gear box 85 and a flexible coupler 78, drives front drive shaft 81 which drives output bevel gear 83 and in turn through an intermediate gear drives front drive gear 84. Motor 80 also drives rear drive shaft 89, which in turn drives auger drive gear 86.

Figure 6:
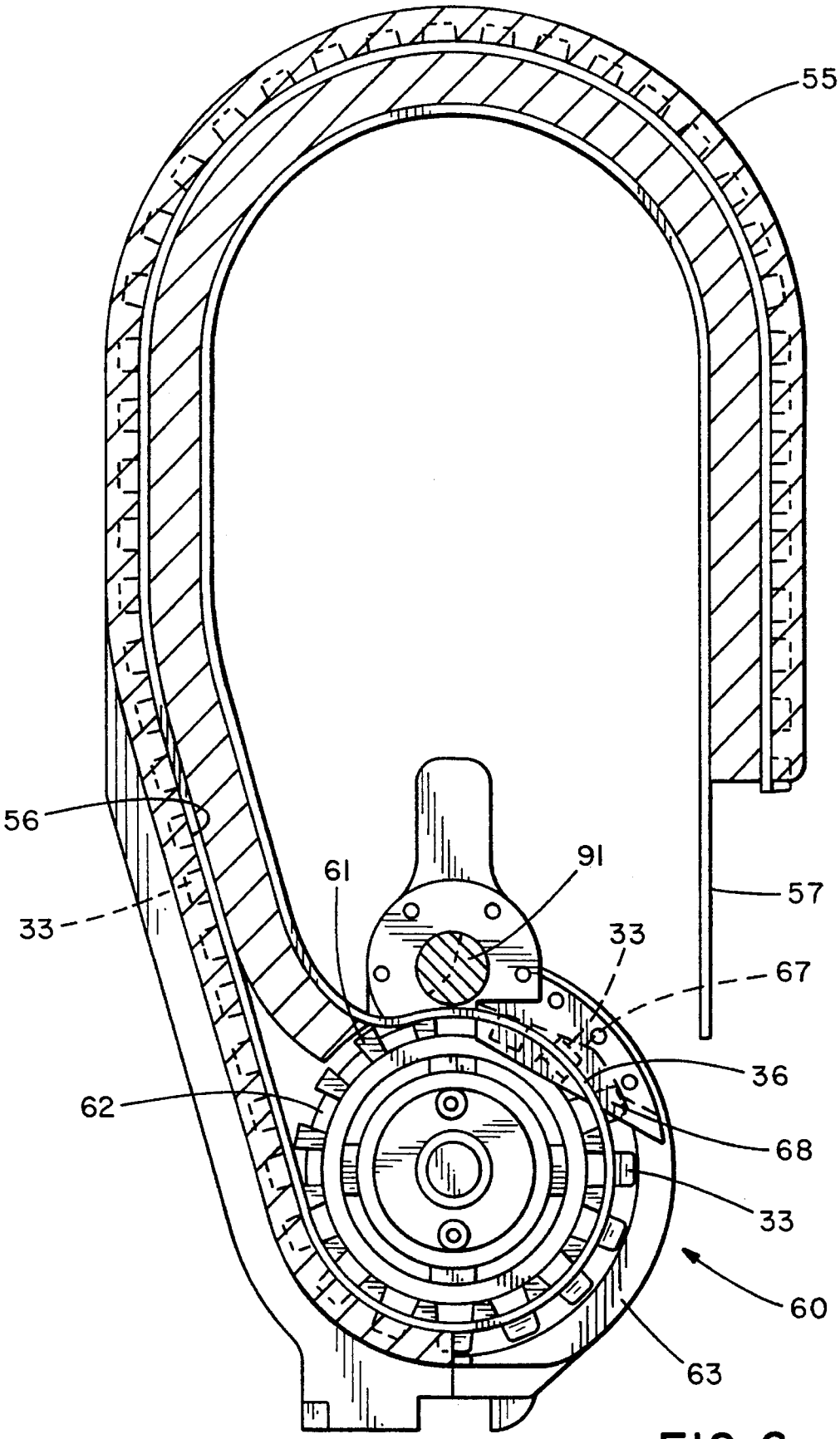
FIG. 6 is a sectional rear view of the receiving mechanism of the tool of FIG. 1.
Figure 8:
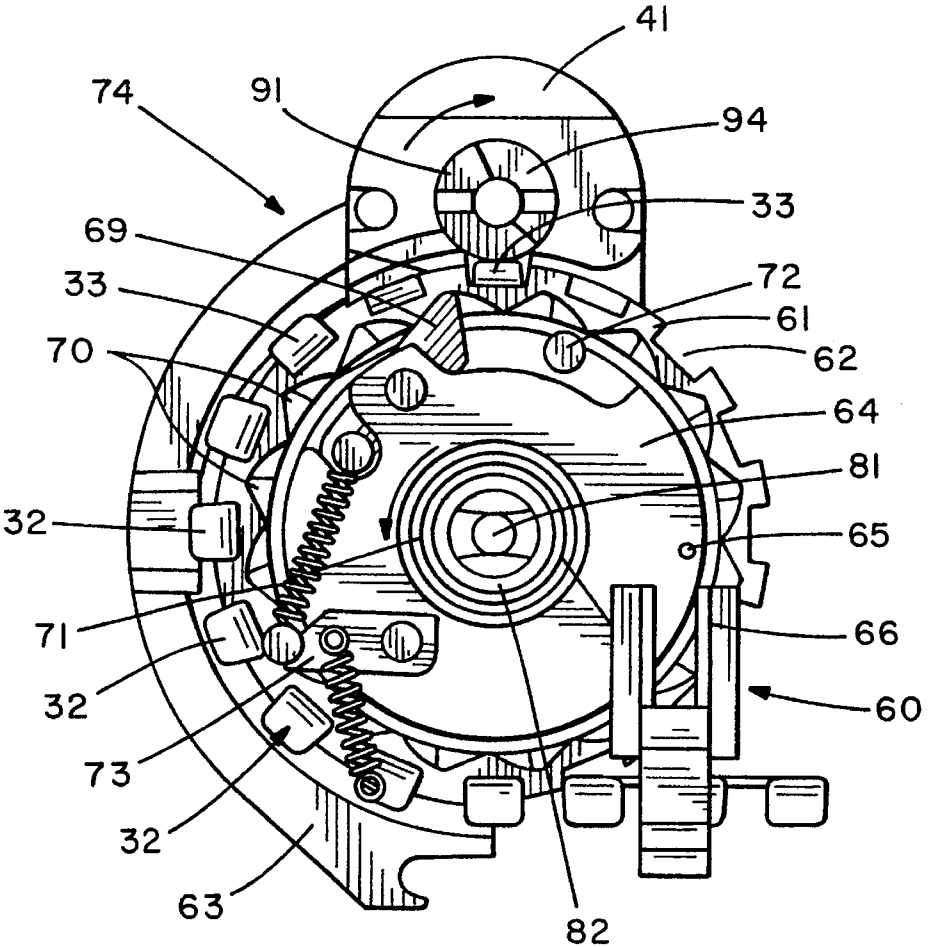
FIG. 8 is a sectional view of the receiving mechanism of the tool of FIG. 1 taken along lines 8—8 of FIG. 2.
Figure 7:
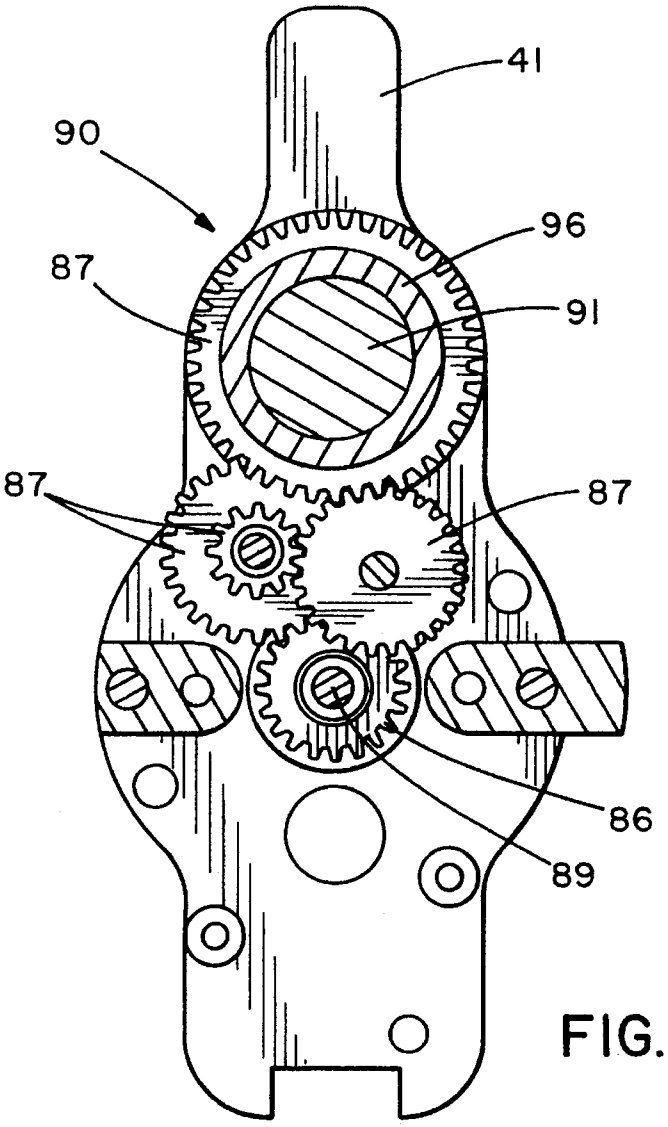
FIG. 7 is a rear view of the gearing of the auger feeding mechanism taken along lines 7—7 of FIG. 2.
Figure 10:
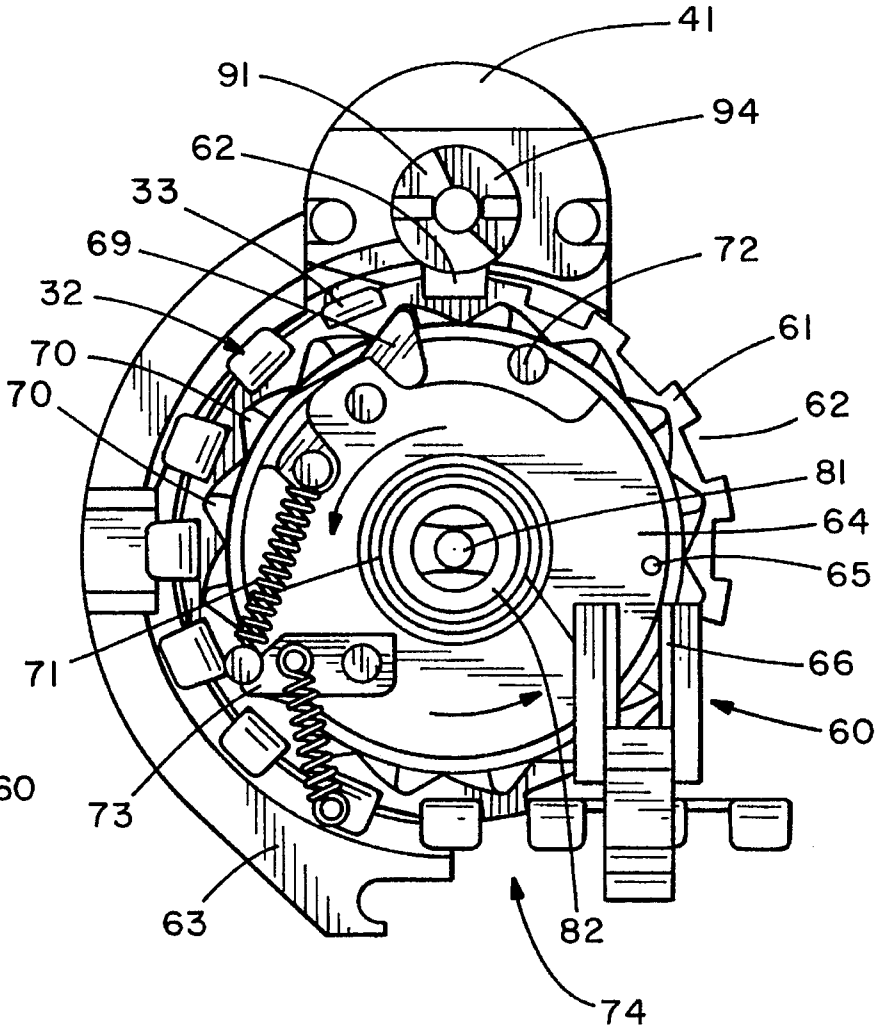
FIG. 10 is a sectional view of the receiving mechanism of the tool of FIG. 1 taken along lines 8—8 of FIG. 2.
Figure 9:
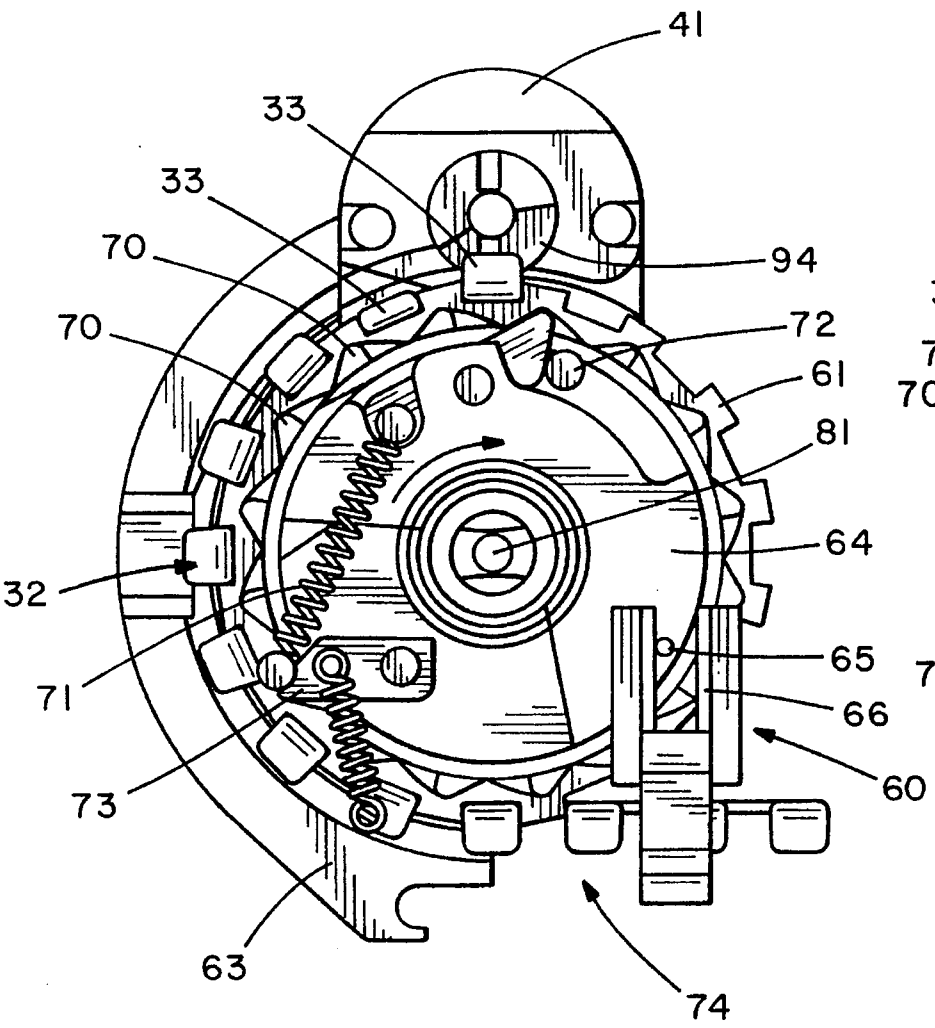
FIG. 9 is a sectional view of the receiving mechanism of the tool of FIG. 1 taken along lines 8—8 of FIG. 2.

As seen in FIGS. 6 and 8, cable tie receiver mechanism 60 includes a rotatably mounted cable tie receiver drum 61 having a plurality of circumferentially spaced longitudinal cable tie holding channels 62, a cable tie strip cutting blade 68, for separating each discrete cable tie 32 from cable tie strip 36, disposed adjacent a rear end of receiver drum 61 (FIG. 6) and a ratchet assembly 74 disposed at a front end of receiver drum 61 (FIG. 8) that is cam actuated to incrementally rotate drum 61 to sequentially position each cable tie 32 positioned in one of the channels 62 for advancement (FIGS. 8–10). A drum cover 63 mounted on the tool frame adjacent drum 61 encloses the leading half of channels 62 to contain cable ties 32 therein.

As seen in FIG. 6, cable tie strip blade 68 mounted to drum cover 63 includes a cam surface 67 and is disposed so as to sever the leading tie 32 from tie strip 35 of cable tie ribbon 31. The cam surface 67 is situated forwardly of blade 68 so as to flex the cable tie head 33 radially inward into a relief space 95 formed circumferentially around drum 61 (see FIG. 12).

As best seen in FIGS. 8–10, ratchet assembly 74 is constructed to incrementally rotate cable tie receiver drum 61 to sequentially position each groove 62 in a position to provide the leading cable tie 32 for advancement in tool 40. In general, ratchet assembly 74 includes ratchet mount 64, having a ratchet pawl 69 which engages one of a plurality of cam surfaces 70 formed in the interior wall of drum 61, to rotate drum 61 until drum 61 is in position to advance the leading cable tie 32.

As seen in FIGS. 2, 7, 11 and 12, cable tie advancing mechanism 90 includes a rotating auger rod 91 having a cable tie transporting groove 93 formed in a helical screw-like pattern, disposed over the receiving drum 61 so as to be positioned above the top channel 62 of the receiver drum 61 such that rotation of the auger rod 91 provides for engagement with the leading cable tie 32 positioned in the top groove 62 and advancement of cable tie 32 to the cable tie tensioning and severing mechanism 100. Motor 80 turns rear drive shaft 89 which drives auger drive gear 86 which through intermediate gears 87 causes rotation of auger rod 91. The transport groove 62 has a recess 94 formed at the rearward end so as to be positioned directly over the head 33 of the cable tie 32 positioned on drum 61 by the ratchet assembly 74 of the receiving mechanism 60. The flexing of head 33 inwardly into relief space 95 allows the auger rod 91 to rotate and head 33 to be positioned for alignment with a relief dwell 94 formed at the start of transport groove 93.

As seen in FIGS. 13–18, cable tie tensioning and severing mechanism 100 includes a front drive gear 84 which is driven by the output bevel gear 83 that is turned by the front drive shaft 81 of the motor 80 through gear box 85 and flexible coupler 78. Front drive gear 84 works through a series of intermediate timing gears and shafts to turn front jaw drive gear 101 and gripper drive gear 122 to control the closing of upper jaw 50, to thread cable tie 32, and force strap 35 into engagement with the gripper gear 120 which in turn pulls strap 35 tight around the bundle 30. A tension adjusting assembly 110 is also provided mechanically linked to the gripper gear mesh as well as a severing blade 118 so that upon reaching a desired tension, tensioning assembly 110 actuates severing link 117 to cut the excess tie strap 35 with blade 118.

Tool 40 is operated as follows. As seen in FIG. 1, a cable tie ribbon 31 is inserted into a track of U-shaped ribbon guide 55 which guides ribbon 31 into cable tie receiver drum 61. Although the use of guide 55 is preferred, tool 40 can be operated without guide 55 by merely inserting a strip of ribbon 31 into drum 61.

The lower and upper jaws 50, 51 are normally in the open position and are placed around the objects to be fastened as seen in FIG. 12. When trigger 44 is pulled rearward the trigger linkage 48 forces the lower jaw 51 to pivot until the lower and upper jaws 50, 51 are closed to surround bundle 30 as in FIG. 15.

When the trigger 44 is pressed and lower jaw 51 closes on upper jaw 50 around bundle 30 an activation blade 45 disposed on the back side of trigger 44 reaches optical sensor 46 which activates the tool control circuitry (not shown) to run the cycle. As a result of a ratchet resetting arrangement to be described in more detail below, at the finish of the preceding cycle, the leading cable tie 32 is already in position to be advanced.

Figure 11:
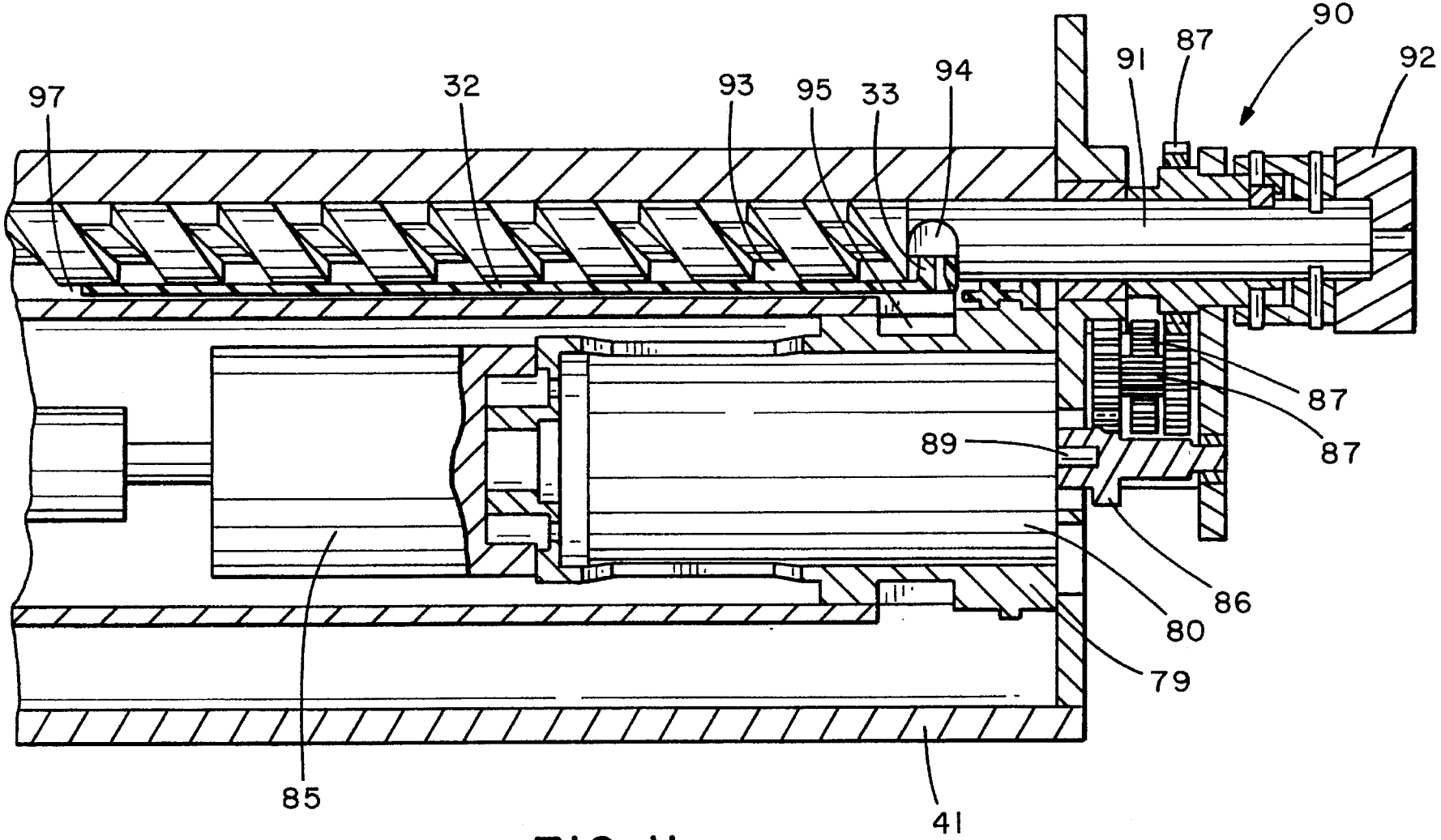
FIG. 11 is a fragmentary side view of the rear of the tool of FIG. 1 showing the advancing mechanism and its gearing.
Figure 16:
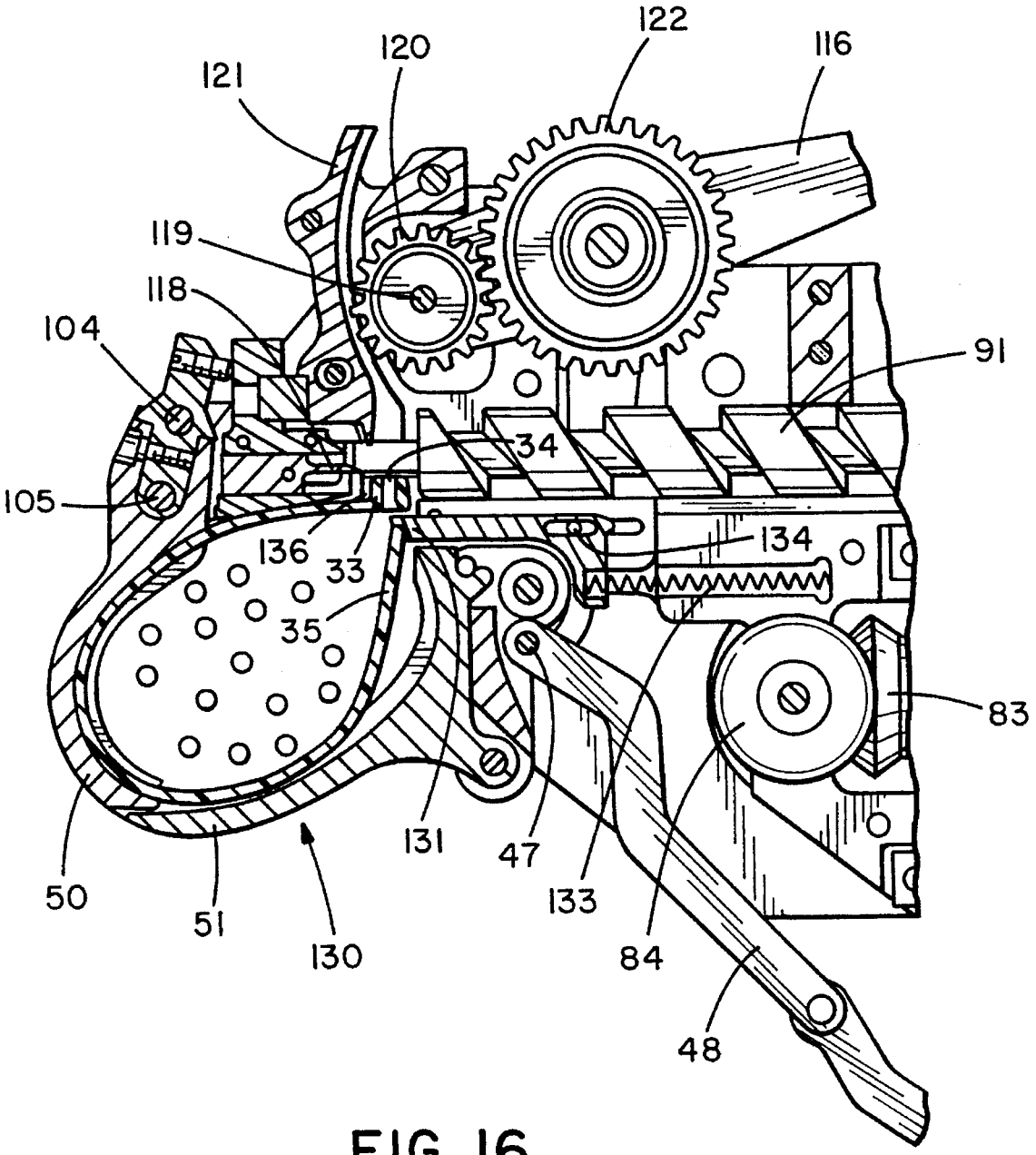
FIG. 16 is a fragmentary side view of the front of the tool of FIG. 1 showing the advancing and positioning mechanisms of the tool and its gearing as the cable tie reaches the tensioning and severing mechanism.
Figure 17:
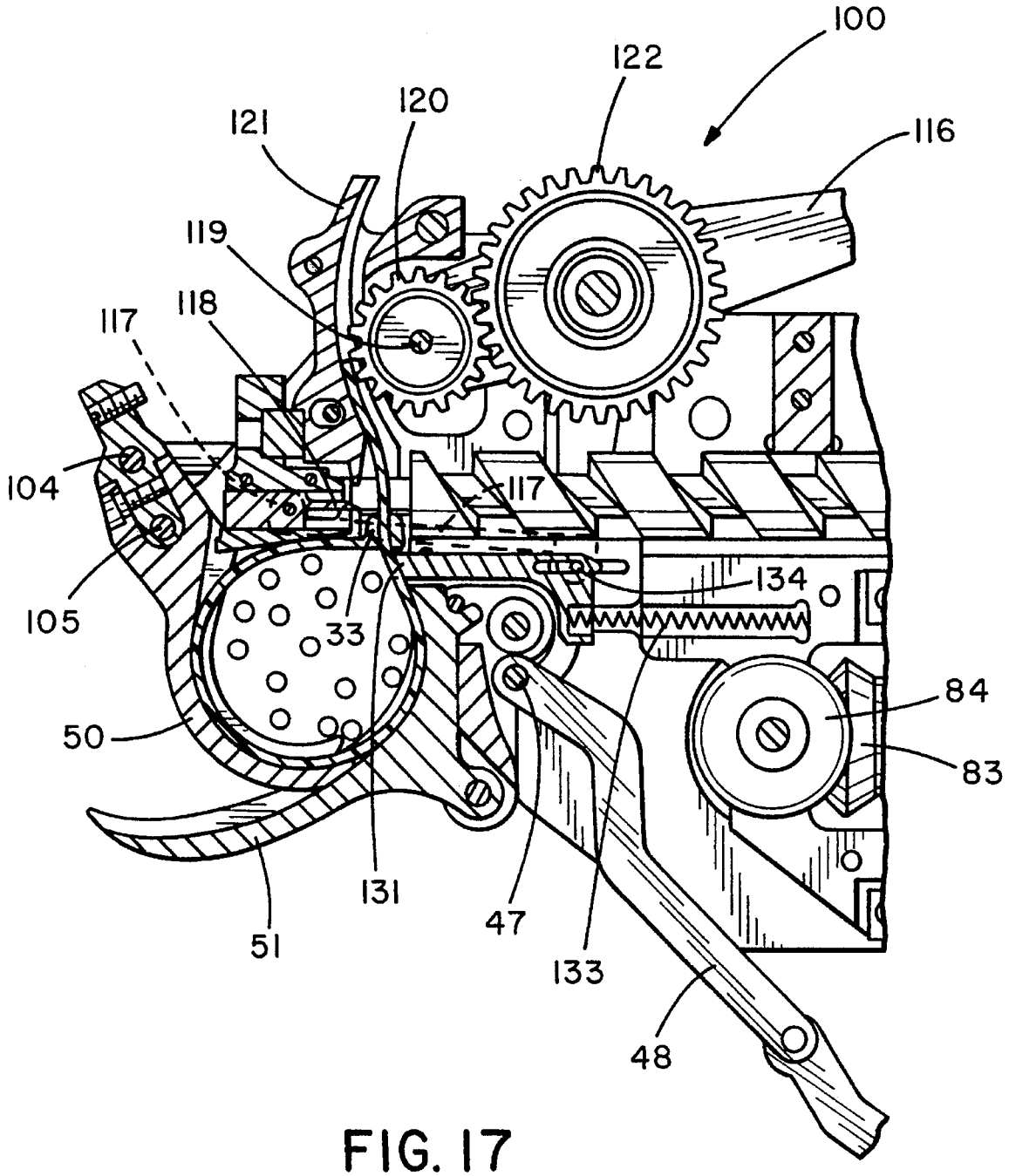
FIG. 17 is a fragmentary side view of the front of the tool of FIG. 1 showing the tensioning and severing mechanisms of the tool.

When the cycle is activated, motor 80 turns front drive shaft 81 through gear box 85 and flexible coupler 78 to power the front end of the tool and a rear drive shaft 89 is simultaneously rotated to power auger drive gear 86. auger rod 91 driven by auger drive gear 86 through intermediate timing gears 87 rotates. As can be seen in FIGS. 11 and 12, as rod 91 rotates above tie 32, head 33, which has been inwardly flexed so that when relief dwell 94 reaches head 33 the head flexes upward into relief dwell 94, becomes engaged with transport groove 93. As the auger continues to rotate, tie 32, which is situated in a channel and prevented from rotation with rod 91, will be longitudinally advanced by the helical arrangement of groove 93 along the tie guide channel 97 which substantially corresponds to the tie holding channel 62 of drum 61 until head 33 reaches head stop 136 as seen in FIG. 16. At this point the tie strap 35 is positioned within the interior jaw channels 52, 53 of the closed upper and lower jaws 50, 51 so that tie 32 is around bundle 30 and strap 35 is positioned adjacent the head opening 34 of cable tie 32. The alignment of strap 35 with opening 34 is achieved by the cable tie positioning assembly 130.

Figure 15:
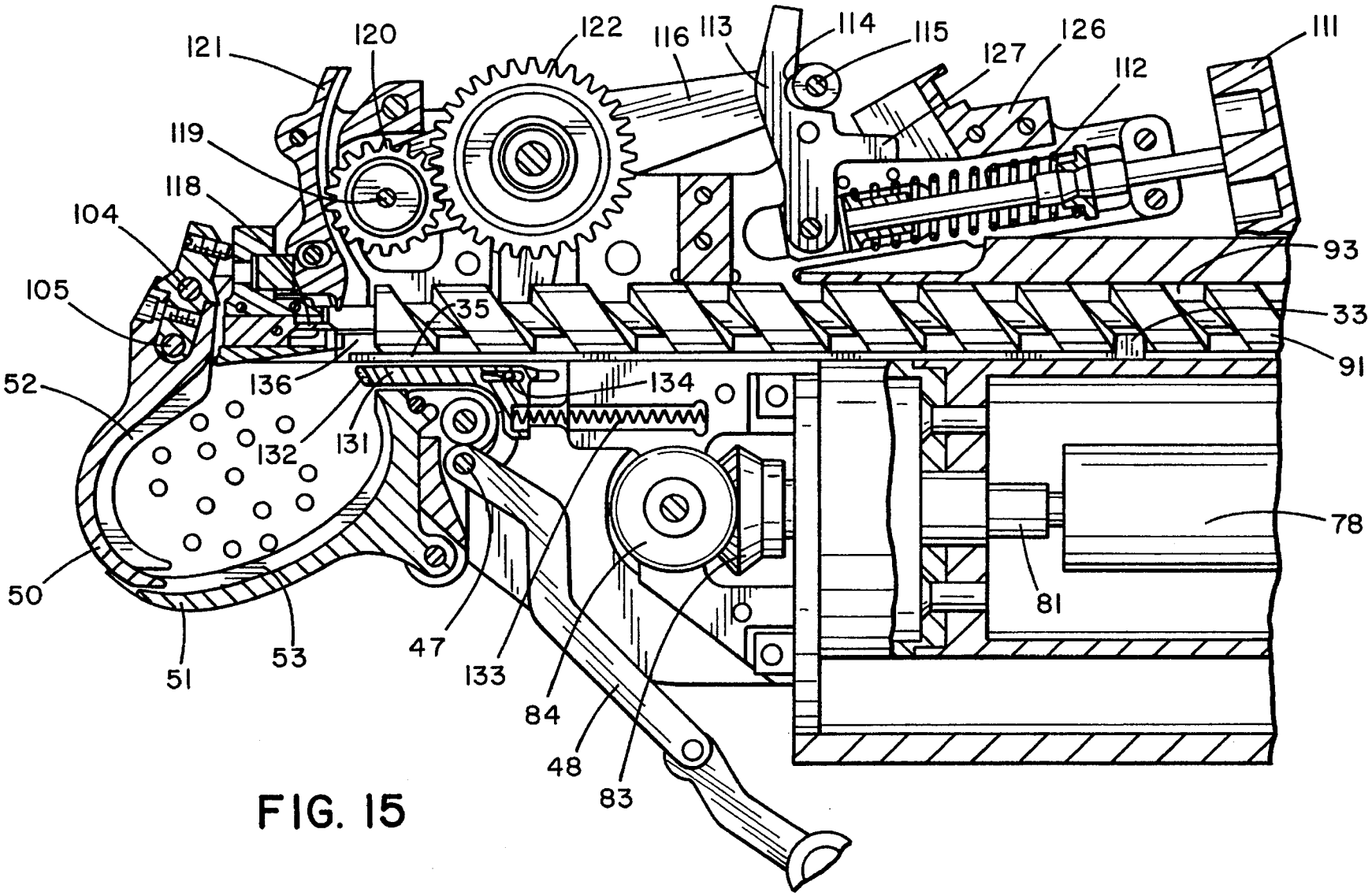
FIG. 15 is a fragmentary side view of the front of the tool of FIG. 1 showing the advancing and positioning mechanisms of the tool and its gearing as the cable tie advances to the tensioning and severing mechanism.
Figure 19:
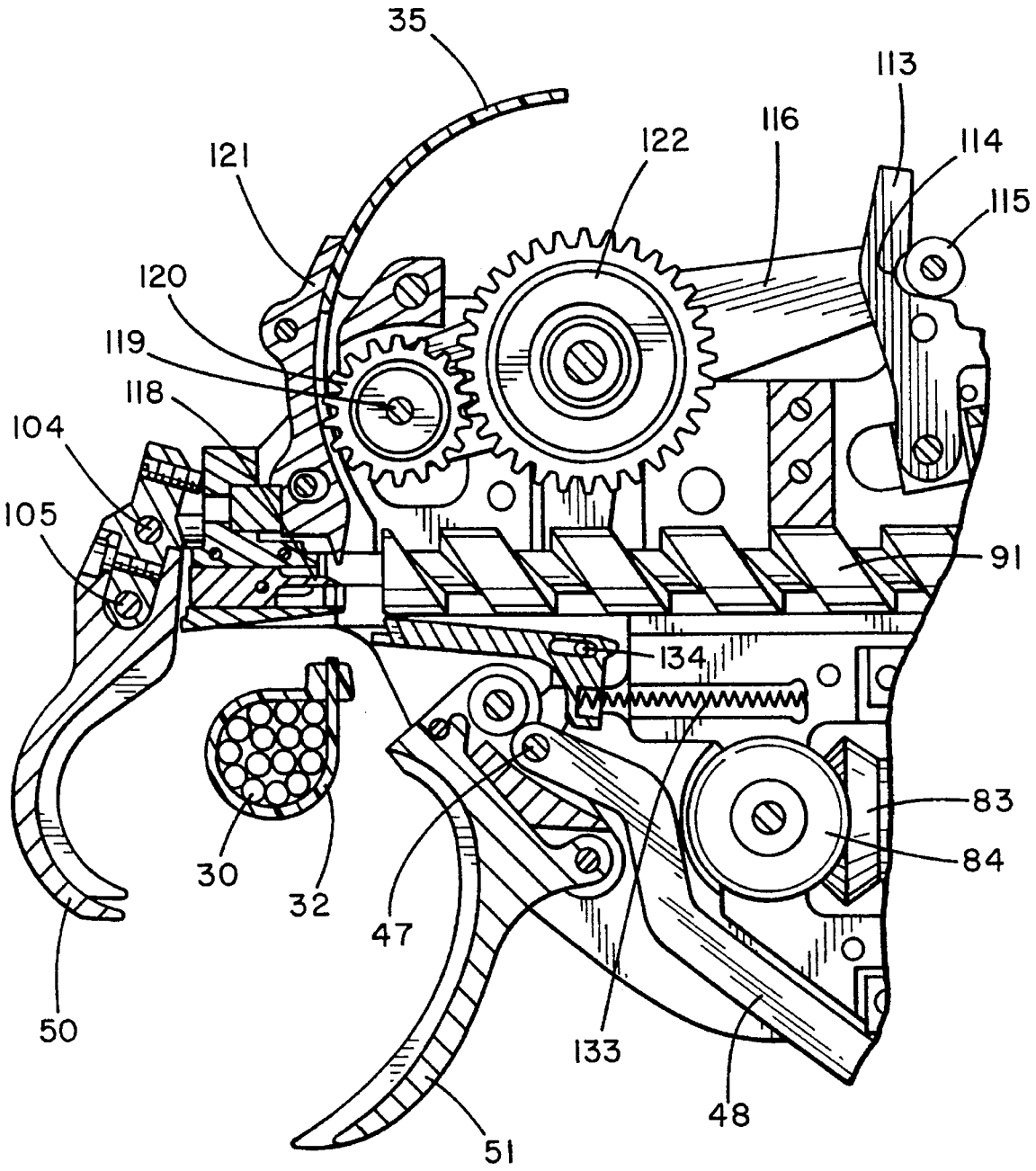
FIG. 19 is a fragmentary side view of the front of the tool of FIG. 1 showing the release of the bundle by the jaws of the tool after severing the excess strap.

As best seen in FIGS. 15, 16 and 19, cable tie positioning assembly 130 includes a pivotally mounted head retainer 131 which is resiliently biased forwardly and upwardly by a spring 133 and pivot 134. Retainer member 131 is disposed and latched (FIG. 19) within tool 40 to present its upper surface adjacent to and in alignment with the path of the cable tie 32 being advanced by the cable tie advancing mechanism 90, such that as the advancing tie 32 hits retainer member 131 breaking the latching engagement (FIG. 15), retainer member 131 pivots downward and is pushed forward by spring 133. Retainer member 131 includes a distal positioning groove 132 and is mounted so that when retainer member 131 is pushed forward it will align positioning groove 132 with interior jaw channel 53 of lower jaw 51 to direct the tip of cable tie 32 into alignment with the head opening 34 of cable tie 32 as shown in FIG. 16.

Figure 14:
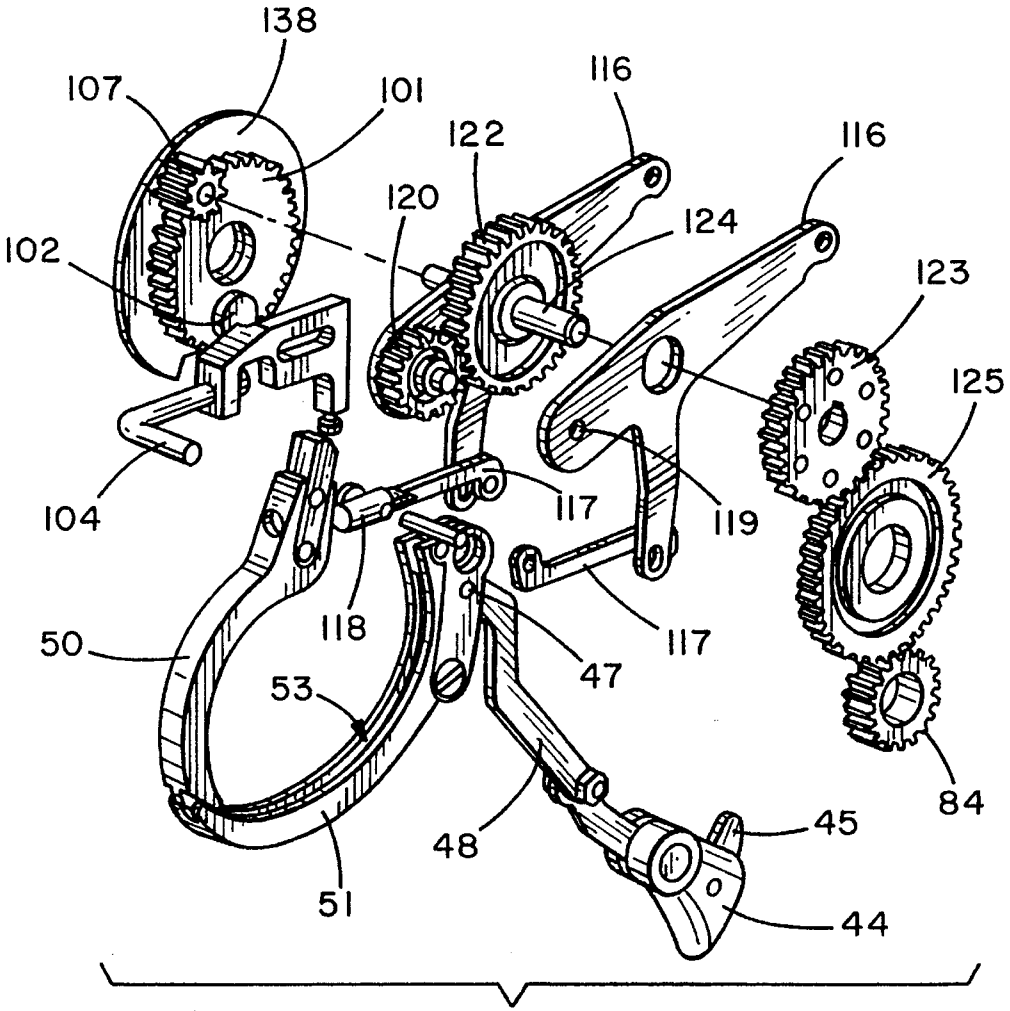
FIG. 14 is an exploded perspective view of the front jaw mechanisms and gearing of FIG. 13.
Figure 13:
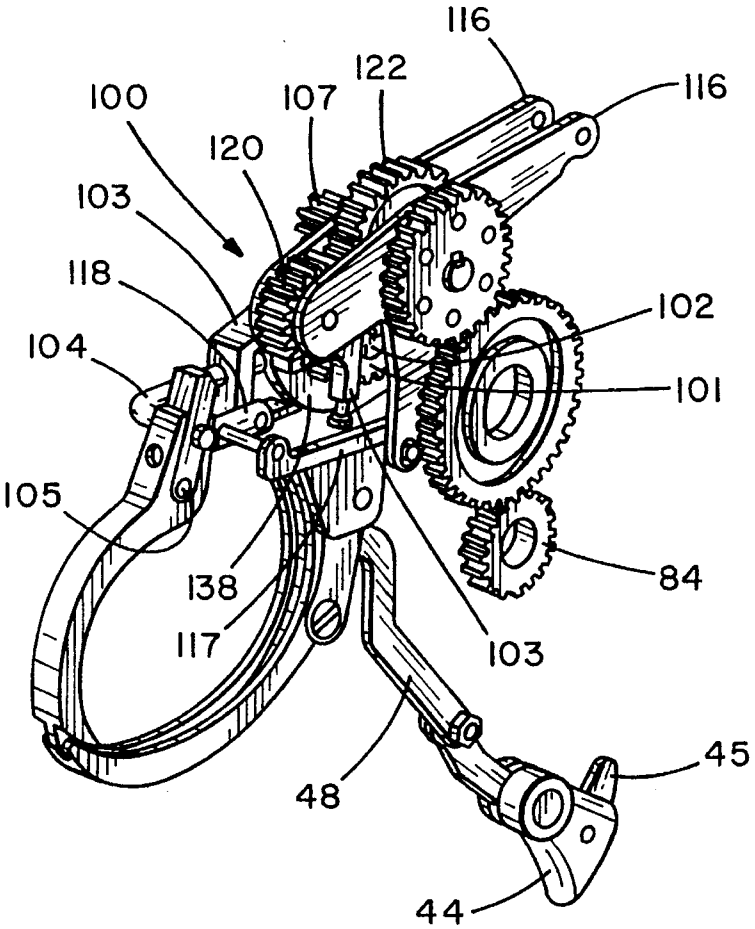
FIG. 13 is a perspective view of the front jaw mechanisms and gearing of the tool of FIG. 1.

As can be seen in FIGS. 13 and 14, the front jaw drive gear 101 is driven through an intermediate gear 107 by a drive shaft 124 which is driven by a gear mesh including gripper drive shaft gear 123 and intermediate gear 125. Tensioning and severing mechanism 100 shown in FIGS. 13 and 14 is timed so that during each cycle of tool 40 actuated by the pulling of trigger 44, when cable tie 32 has been advanced and positioned within the jaws 50, 51 around bundle 30 as shown in FIG. 16, a front jaw cam roller 102, which is revolving along with front jaw drive gear 101, engages front jaw cam link 103 to push link 103 forward to force front jaw lever 104 forward resulting in the upper jaw 50 pivoting about pivot 105 to rotate in thereby threading strap 35 through opening 34 and forcing strap 35 into engagement with the gripper gear 120 (see FIGS. 17 and 20). It is noted that in the preferred embodiment shown here, the front jaw drive gear 101 is timed so that it makes one rotation per tool cycle and that it travels one quarter (¼) revolution to rotate upper jaw 50 in all the way. Overload spring 106 prevents jamming of the tensioning and severing mechanism 100, if an oversize bundle is in jaws. The upper jaw 50 is returned to its normal position after front jaw cam roller 102 has revolved past cam link 103, by front jaw return extension spring 108 shown in FIG. 20.

As seen in FIGS. 17–21, the strap 35 of cable tie 32 is directed into engagement with gripper gear 120 and is driven between gripper backstop 121 and gripper gear 120 which continuously rotates in a clockwise direction to apply tension to cable tie 32 by pulling strap 35 tight around wires 30.

Figure 18:
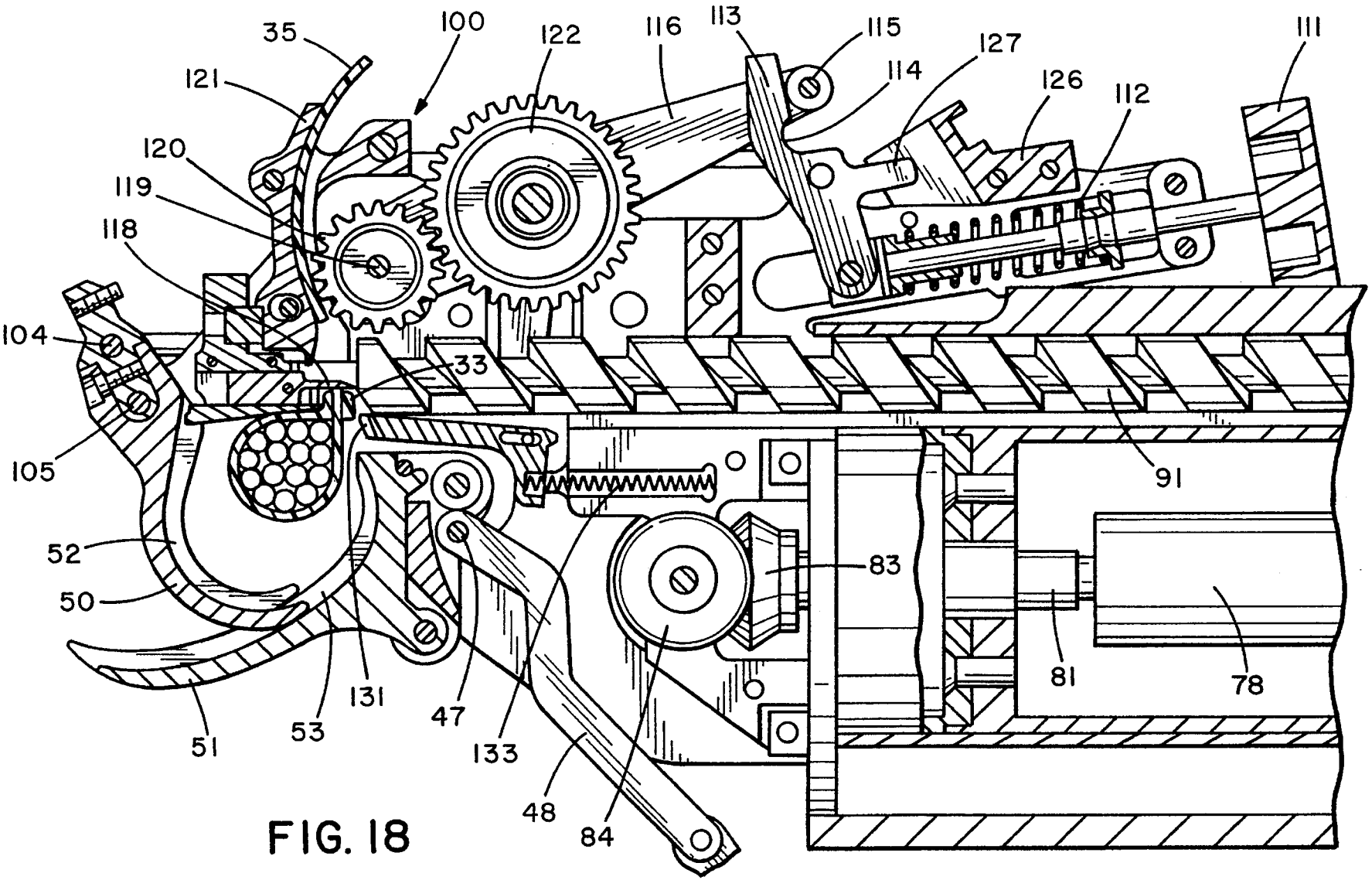
FIG. 18 is a fragmentary side view of the front of the tool of FIG. 1 showing the severing mechanism of the tool.

As can be seen in FIGS. 12–18, tension adjusting assembly 110 which is mechanically linked to gripper gear 120 applies a preset force through a tension limiting spring 112 to tension retainer link 113 which is translated to detent cam follower 115 such that as gripper gear 120 pulls on strap 35 of cable tie 32, increasing the downward force applied to forward arms of left and right gripper detent links 116, a point is reached where the downward force overcomes the force applied by tension assembly and gripper gear 120 starts walking down strap 35 which pivots left and right gripper detent links 116 counterclockwise as shown in FIG. 18. As seen in FIGS. 13 and 18, when gripper detent links 116 rotate, they pull on the pin attached to head retainer 131 to replace it in the rearward position, and links 116 also pull on severance link 117 which causes severance blade 118 to cut the excess strap from the tensioned tie. When the excess tie strap has been cut a return spring 112 forces detent links 116 back into position and engagement of cam follower 115 with detent 114. This return of detent 114 also causes activation of sensor 126, via activation blade 127 disposed on the back side of detent 114, indicating to the control circuit that the tie strap is cutoff and the cycle was successfully completed. Continued rotation of gripper gear 120 drives the severed strap out the ejection aperture (not shown) into strap collector 145.

Figure 20:
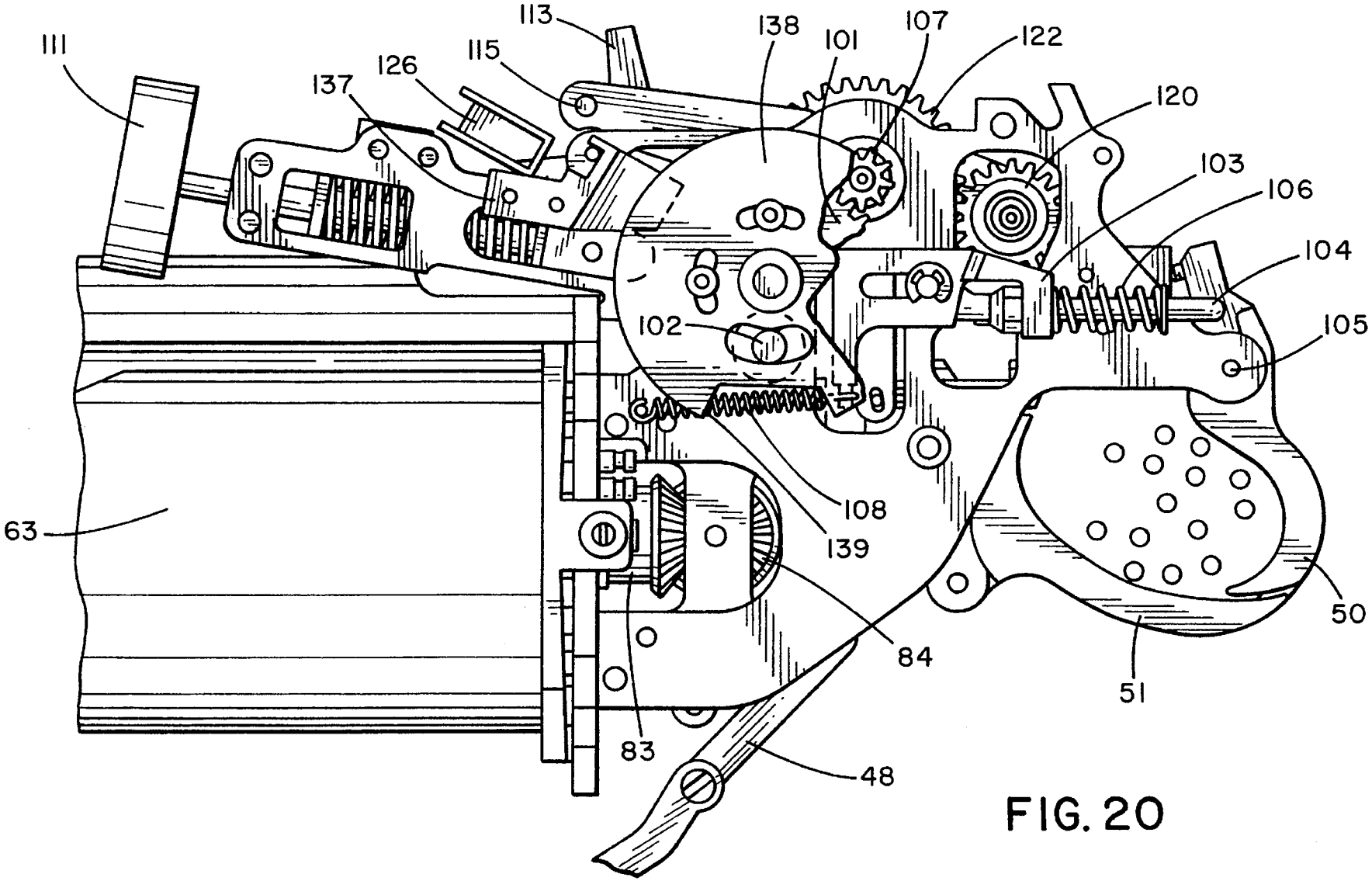
FIG. 20 is a fragmentary side view of the second side of the front of the tool of FIG. 1 showing the timing assembly for the tensioning and severing mechanisms of the tool.
Figure 21:
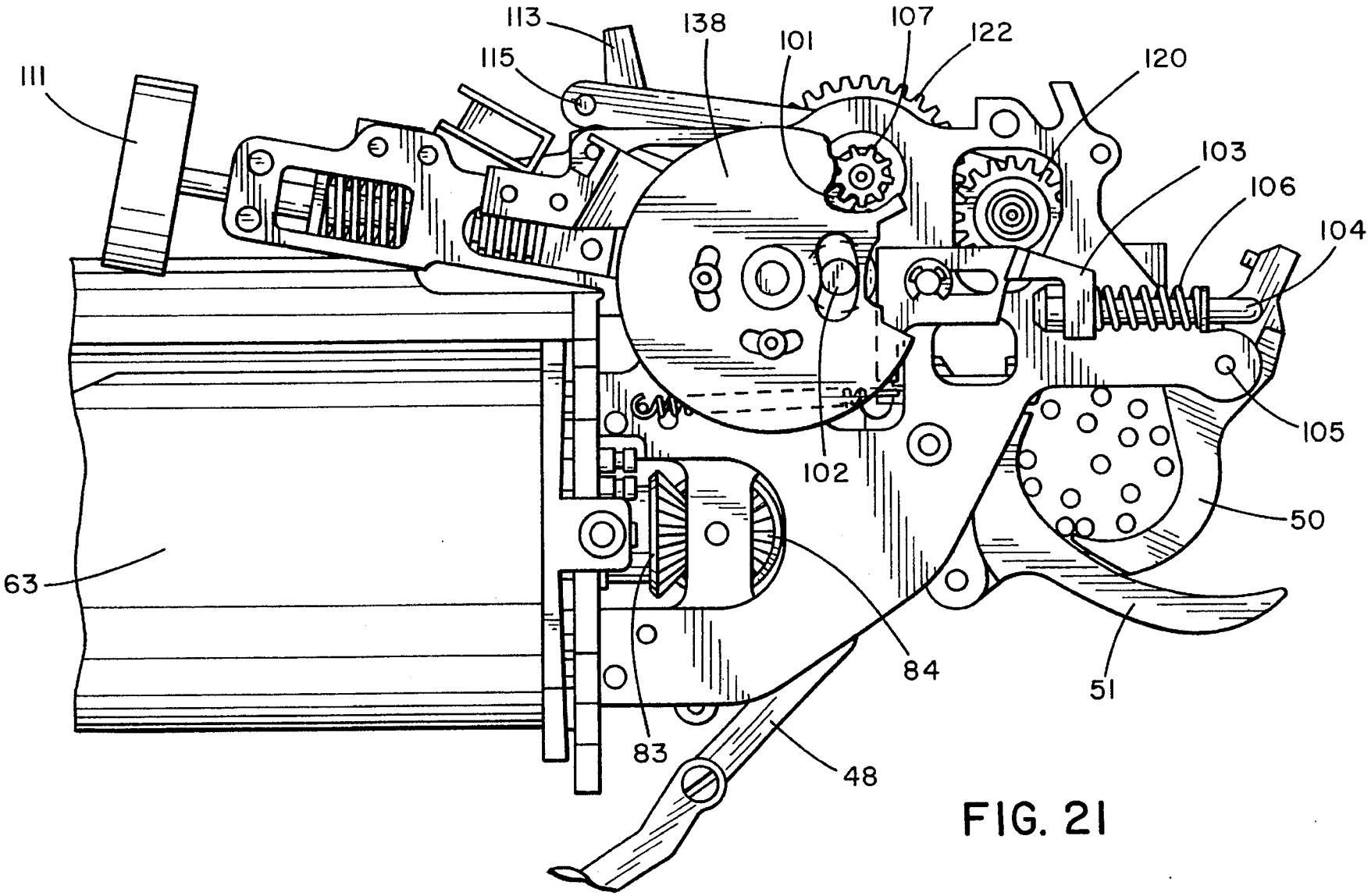
FIG. 21 is a fragmentary side view of the second side of the front of the tool of FIG. 1 showing the timing assembly for the tensioning and severing mechanisms of the tool.

As can be seen in FIGS. 20 and 21, tool 40 also includes position disk 138 which includes timing control cutout 139 and is also timed so that it also completes one revolution per tool cycle. The revolution of disk 138 is timed so that when sensor 137 first sees cutout 139 the circuitry tells motor 80 to slow down and when optical sensor 137 senses the second edge of disk 138 at the end of cutout 139, indicating that the front jaw is returned to the original position, the circuitry reverses the direction of motor 80. The reversing direction of motor 80 actuates the ratchet assembly 74 to position the next cable tie 32 at the top channel 62 of drum 61.

Ratchet assembly 74 as seen in FIGS. 8–10 allows for a one way clutch 82 that is disposed around shaft 81, which had been slipping so that drum 61 remained stationary during advancement of cable tie 32 to the front jaws 50, 51, to engage front drive shaft 81 and rotate ratchet mount 64. As the ratchet mount 64 rotates clockwise (looking at it from the front of tool 140), ratchet pawl 69 will engage drum 61 in a cam surface 70 formed circumferentially around the interior of drum 61 to rotate drum 61 clockwise to position the next cable tie 32 for the advancing mechanism 90. When ratchet pawl 69 reaches the ratchet stop pin 72 as seen in FIG. 9, drum 61 has turned sufficiently to properly position the leading cable tie 32 and stop drum 61. Ratchet mount pin 65 will reach ratchet mount sensor 66 which turns motor 80 off as tool 40 is ready for the next cycle. When the trigger activation blade 45 activates the next cycle so that the cable tie 32 just positioned will be advanced, ratchet pawl 69 is released and the ratchet mount return spring 71 automatically recocks to return ratchet pawl 69 for the next cycle as seen in FIG. 10. Anti backup ratchet pawl 73 also fits into the cam surface 70 and prevents the drum 61 from turning back as the ratchet mount 64 recocks.

As previously discussed, during the positioning of the leading cable tie 32 into the top groove 62 position of drum 61, the trailing cable ties 32 of ribbon 31 are advanced past severing blade 68 to sever each tie 32 from strip 36 and to flex the head 33 radially inward so when tie 32 is positioned at the top of cable tie receiver drum 61, it is aligned with the relief dwell 94 of transport channel 93 of the auger rod 91. As seen in FIG. 12, the flexing downward of tie head 33 into relief space 95 formed circumferentially around drum 61 allows for the ties 32 to be positioned in the top channel 62 of drum 61 without the need for precisely timing the transport groove relief dwell 94 with the arrival of cable tie 32 at the top channel 62 position.

Figure 22:
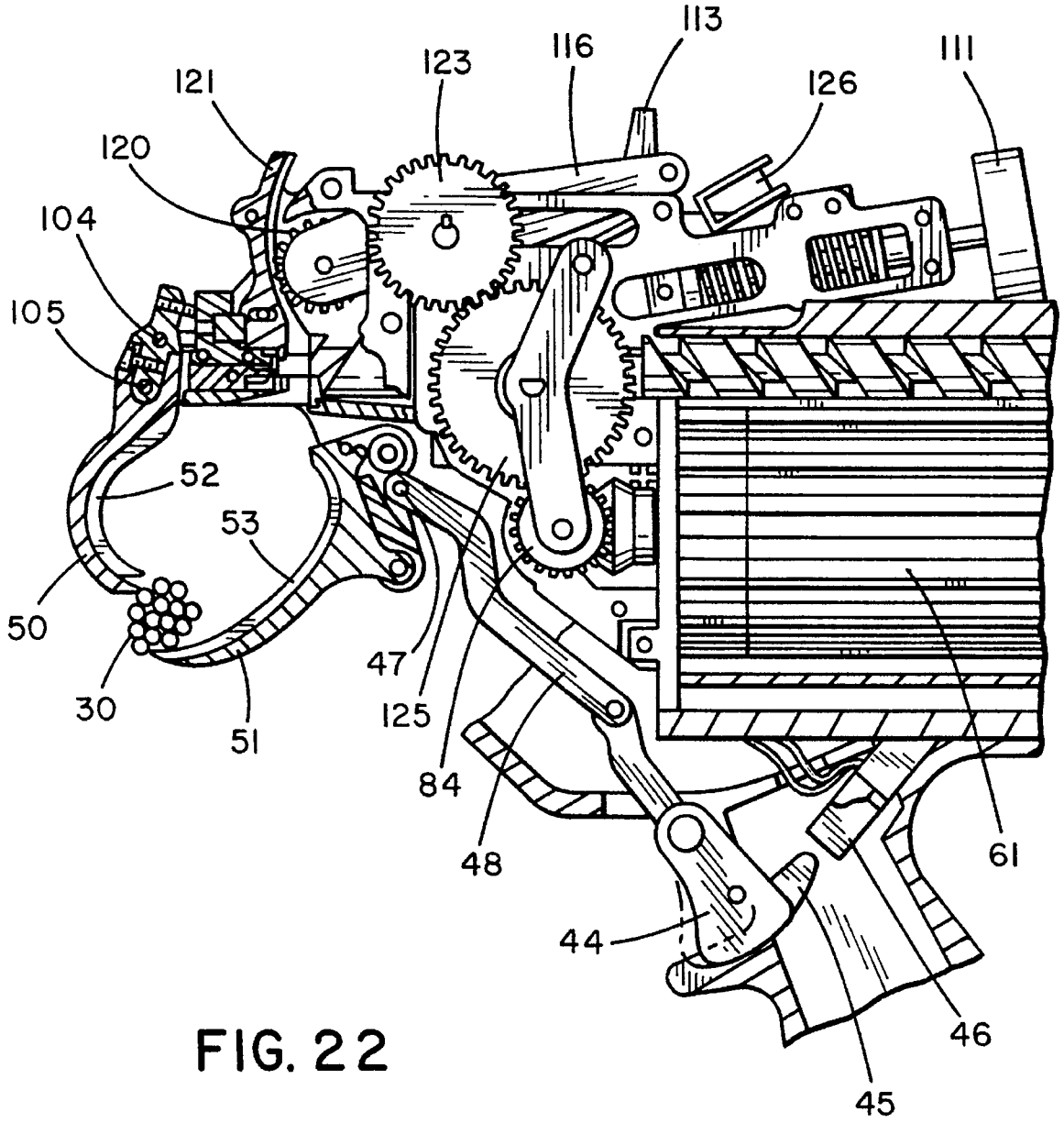
FIG. 22 is a fragmentary side view of the misfeed preventing mechanism of the tool of FIG. 1.

As can be seen in FIG. 22, that during operation of tool 40, if the lower jaw 51 does not properly close around bundle 30, such as when the bundle is too large or has been misaligned within the open jaws, the end of lower jaw 51 will not meet with upper jaw 50 to completely attain the closed position around the bundle of wires 30. In this instance, trigger 44 cannot complete its full movement and the activation blade 45 does not reach the optical sensor 46 which in turn does not activate the tool control circuitry which runs the motor 80 and activates the advancing and tensioning of the cable tie. This arrangement is significant as it prevents any misfeed of cable tie 32 from occurring when the tool 40 is not properly positioned to apply a cable tie 32.

Figure 23:
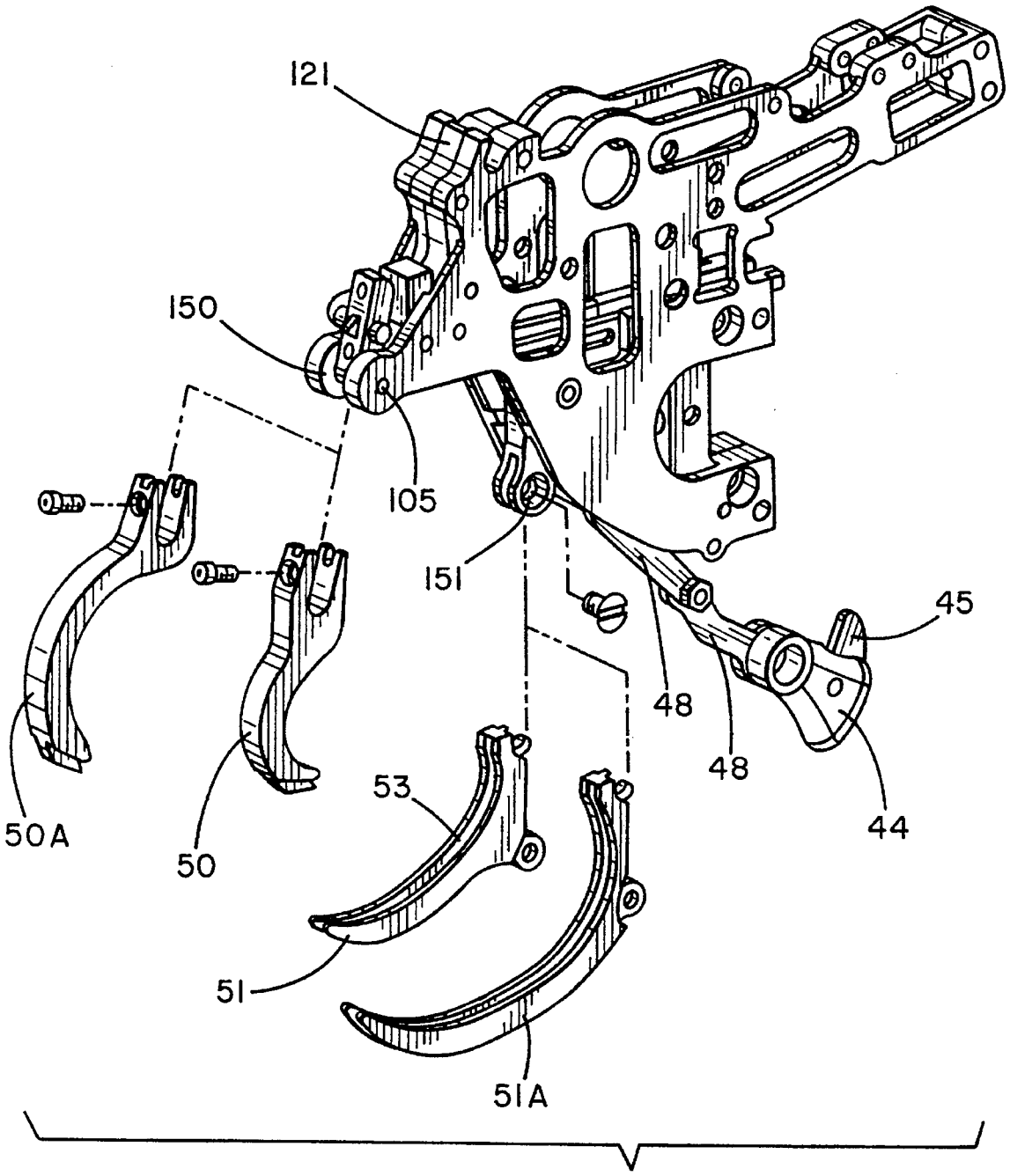
FIG. 23 is an exploded perspective view of the interchangeable front jaw assembly of the tool of FIG. 1.

Additionally, since the timing of the tool cycle is independent of the cable tie length and mechanically designed into the gearing system, no adjustments are needed for operating the tool using cable ties of different lengths, other than the changing of the upper and lower jaws. As seen in FIG. 23, jaws 50, 51 can be easily replaced with jaws 50A, 51A for a larger length cable tie by removing screws and reapplying the new jaws 50A, 51A into jaw joints 150, 151.

While particular embodiments of the present invention have been shown and described, it will be obvious to those skilled in the art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An automatic cable tie installation tool for fastening an individual cable tie around a bundle of wires or the like, comprising:

cable tie positioning means for positioning the cable tie around a bundle;

cable tie receiver means for receiving and positioning the cable tie for advancement to the cable tie positioning means;

tensioning means for tensioning the cable tie around a bundle; and cable tie advancing means for transporting the cable tie from the receiving means to the positioning means, wherein the advancing means includes a rotary driven rod having a helical groove that engages with a head of the cable tie.

2. An automatic cable tie installation tool according to claim 1, wherein the receiving means includes a rotatably mounted cable tie receiver drum having a plurality of circumferentially spaced longitudinal cable tie holding channels.

3. An automatic cable tie installation tool according to claim 2, wherein the rotary driven rod is disposed above a top holding channel of the receiver drum.

4. An automatic cable tie installation tool according to claim 1, including a recess dwell formed on the rod at a receiving end of the helical groove and positioned so as to be directly above the head of a cable tie situated in the top holding channel such that upon rotation of the rotary driven rod, the recess dwell engages the head.

5. An automatic cable tie installation tool according to claim 4, wherein the receiving means includes a cam surface arranged to flex the head of a leading cable tie radially inward into a circumferential relief space formed in the drum to await alignment with the recess dwell as the rod rotates.

6. An automatic cable tie installation tool according to claim 1, wherein the cable tie advancing means and the tensioning means are both driven by a single electric motor.

7. An automatic cable tie installation tool according to claim 1, including a battery pack removably attached to the tool.

8. An automatic cable tie installation tool according to claim 1, further including severing means for cutting excess strap of a tensioned tie.

9. An automatic cable tie installation tool for fastening an individual cable tie having a strap and a strap locking head around a bundle of wires or the like, comprising:

a tool body;

a housing enclosing the tool body;

upper and lower jaws for accepting a cable tie for positioning around a bundle;

a receiver drum rotatably mounted on the tool body and including a plurality of circumferentially spaced cable tie holding channels for receiving a plurality of cable ties and sequentially positioning a leading cable tie in a top channel with the strap locking head in a trailing position;

a rotary driven rod having a helical groove beginning with a recess dwell in the rod positioned over the top channel so as to be aligned with the strap locking head of the cable tie to advance the cable tie to the upper and lower jaws as the rod rotates; and tensioning means for tensioning the cable tie around a bundle.

10. An automatic cable installation tool according to claim 9, wherein the helical groove extends from the recess dwell longitudinally along the rod to a head stop which positions the cable tie in the upper and lower jaws.

11. An automatic cable tie installation tool according to claim 10, including a cam surface adjacent the receiver drum and disposed to flex the head of a leading cable tie radially inward into a circumferential relief space formed in the drum to await alignment with the recess dwell as the rod rotates.

12. An automatic cable tie installation tool according to claim 9, wherein the rotary driven rod and the tensioning means are both driven by a single electric motor.

13. An automatic cable tie installation tool according to claim 9, including a battery pack removably attached to the tool.

14. An automatic cable tie installation tool according to claim 9, further including severing means for cutting excess strap of a tensioned tie.

15. A portable automatic cable tie installation tool for fastening an individual cable tie around a bundle of wires or the like where the cable tie has a strap and a strap locking head and is provided on a continuous ribbon of ties, comprising:

upper and lower jaws for positioning the cable ties around a bundle to be fastened;

cable tie receiver means for receiving the ribbon of cable ties, separating a leading cable tie from the ribbon and positioning the cable tie for advancement to the upper and lower jaws;

tensioning means for tensioning the cable tie around the bundle; and cable tie advancing means for transporting the cable tie from the receiving means to the tensioning means, wherein the advancing means includes a rotary driven rod having a helical groove that engages the head of the cable tie and advances the cable tie to the upper and lower jaws as the rod rotates.

16. An automatic cable tie installation tool according to claim 15, further including severing means for cutting excess strap of a tensioned tie.

17. An automatic cable tie installation tool for fastening an individual cable tie around a bundle of wires or the like, having a pair of normally open front jaws, movable between an open and a closed position, in which a cable tie is closed around a bundle, and including automatic cable tie advancing means for the automatic advancing of the cable tie to the front jaws comprising:

means for preventing actuation of the automatic cable tie advancing means until the front jaws are in the closed position, including a tool circuitry control sensor positioned within the housing;

an activation blade disposed on the trigger which activates the tool control circuitry; and trigger linkage means for preventing the blade from reaching the sensor when an obstruction prevents the front jaws from attaining the closed position; and wherein the cable tie advancing means includes a rotary driven rod having a helical groove that engages with a head of the cable tie.

18. An automatic cable tie installation tool for fastening an individual cable tie around a bundle of wires or the like, comprising:

advancing means for advancing the cable tie independent of the length of the cable tie to a bundling position;

bundling means, including an upper and a lower jaw, for tensioning an individual cable tie around a bundle and severing the excess strap;

timing means for the advancing and bundling means independent of the cable tie length; and interchangeable jaw means for allowing attachment of upper and lower jaws of different sizes corresponding to the length of the cable tie to be applied around the bundle.

19. An automatic cable tie installation tool according to claim 18, wherein the cable tie advancing means includes a rotary driven rod having a helical groove that engages with a head of the cable tie.

* * * * *